US007156722B2

(12) United States Patent
Min et al.

(10) Patent No.: US 7,156,722 B2
(45) Date of Patent: Jan. 2, 2007

(54) PLATEN STRUCTURE OF POLISHING APPARATUS FOR PROCESSING SEMICONDUCTOR WAFER AND METHOD FOR EXCHANGING POLISHING PAD AFFIXED TO THE SAME

(75) Inventors: Chung-Ki Min, Gyeonggi-do (KR); Yong-Sun Ko, Gyeonggi-do (KR); Kyung-Hyun Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 11/260,902

(22) Filed: Oct. 28, 2005

(65) Prior Publication Data

US 2006/0105686 A1 May 18, 2006

(30) Foreign Application Priority Data

Nov. 16, 2004 (KR) ..... 10-2004-0093369

(51) Int. Cl.
*B24B 1/00* (2006.01)

(52) U.S. Cl. ..... 451/41; 451/285; 451/287; 451/494

(58) Field of Classification Search ..... 451/41, 451/285, 287, 494
See application file for complete search history.

(56) References Cited

U.S. PATENT DOCUMENTS 5,660,581 A * 8/1997 Shin et al. ..... 451/289
5,704,827 A * 1/1998 Nishi et al. ..... 451/285
5,921,852 A * 7/1999 Kimura et al. ..... 451/285
6,244,941 B1 * 6/2001 Bowman et al. ..... 451/287
6,379,221 B1 4/2002 Kennedy et al.
6,520,895 B1 2/2003 Senga et al.
6,602,380 B1 8/2003 Doan et al.
6,663,470 B1 * 12/2003 Doan et al. ..... 451/41
7,001,251 B1 * 2/2006 Doan et al. ..... 451/41
2003/0114079 A1 * 6/2003 Berkstresser et al. ..... 451/28

FOREIGN PATENT DOCUMENTS

JP 405191036 * 7/1993

* cited by examiner

*Primary Examiner*—Eileen P. Morgan
(74) *Attorney, Agent, or Firm*—Marger Johnson & McCollom, P.C.

(57) ABSTRACT

A platen structure of a polishing apparatus for semiconductor wafer and a method for exchanging a polishing pad affixed to the same are provided in which the polishing pad supported by the platen is exchanged with convenience within a short time. The platen structure of the polishing apparatus in which the polishing pad attached to the platen of the polishing apparatus comprises a pad plate to which the polishing pad for polishing a wafer is attached, and a platen body combined with the pad plate and having at least one vacuum hole formed thereto to provide a vacuum passage.

20 Claims, 6 Drawing Sheets

PLATEN STRUCTURE OF POLISHING APPARATUS FOR PROCESSING SEMICONDUCTOR WAFER AND METHOD FOR EXCHANGING POLISHING PAD AFFIXED TO THE SAME

CROSS-REFERENCE TO RELATED APPLICATION

This application claims the benefit of Korean Patent Application No. 10-2004-0093369, filed Nov. 16, 2004, the disclosure of which is hereby incorporated herein by reference in its entirety.

BACKGROUND OF THE INVENTION

1. Technical Field

The present invention relates to a polishing apparatus for a semiconductor wafer and, more particularly, to a platen structure of the polishing apparatus, and to a method for exchanging a polishing pad affixed to the same. This can allow the polishing pad for planarizing a metallic layer formed on the wafer surface to be exchanged for a new pad without interrupting the operation of the equipment in the manufacturing process of semiconductor devices.

2. Discussion of Related Art

Generally, semiconductor devices have a step whose height is increased with high densification, scale-down in line width, and multi layered metallization. In order to planarize this step, various planarizing methods such as spin on glass (SOG), etchback, reflow and the like have been developed and employed.

As for such planarizing process for wafers, there are two methods comprising a mechanical polishing method and a chemical polishing method. The mechanical polishing has a drawback of forming a strained layer in the wafer during polishing. Although such strained layer is not formed, the chemical polishing also has a drawback in that it is difficult to form a planarized shape on the wafer. Thus, obtaining shape precision is not easy to accomplish. A planarizing process has been developed combining mechanical and chemical polishing, i.e., a chemical mechanical polishing (CMP) technology. The CMP process is implemented by rotating a polishing table on which a polishing pad is attached. This is done while pressing a polishing head being rotated and vibrated at a time, with a certain pressure exerted towards the polishing table. The polishing head is attached by means of surface tension or vacuum. Then, the wafer surface contacts the polishing pad using the weight of the polishing head itself and pressure applied from an exterior source. A slurry of polishing solution flows through a fine gap between the contact surfaces to facilitate a mechanical removal operation by grinding particles contained in the slurry and surface protrusions of the polishing pad, and a chemical removal operation by chemical components of the slurry.

Such a polishing apparatus is disclosed in U.S. Pat. No. 6,520,895 B2. The polishing apparatus of U.S. Pat. No. 6,520,895 B2 includes a wafer chuck for supporting a wafer while directing the wafer surface to be polished upwards, a polishing pad for polishing the surface to be polished, and a polishing head for supporting the polishing pad while directing the grinding surface of the pad downwards. In this polishing apparatus, a vacuum suction device is provided at a lower portion of the polishing head so as to detachably and fixedly support the polishing pad such that the grinding surface of the pad faces downwards, by which the vacuum suction device and the polishing pad supported by the polishing head can be automatically exchanged.

The conventional polishing apparatus of FIGS. 1, 2*a* and 2*b*, respectively, includes a polishing head 10 for vacuuming a wafer 12, a polishing pad 16 mounted below the polishing head 10 so as to polish the wafer 12, a platen 20 for fixing the polishing pad 16, a pad conditioner 14 mounted spaced in horizontal direction located apart at a certain distance from the polishing head 10 so as to maintain the surface state of the polishing pad 16 constant, a cleaning cup 18 for cleaning the pad conditioner 14, and a head cup load unit (HCLU) 22 for loading the wafer 12 to the polishing head 10.

The wafer 12 loaded from the HCLU 22 is moved by vacuum onto the polishing head 10, and the polishing head 10 retaining the wafer 12 moves the wafer 12 toward each platen 20. After the movement, the polishing head 10 exerts a pressure toward the platen, thus to the wafer positioned between the polishing pad 16 of the platen 20 and the polishing head 10. Then, the polishing pad 16 and the polishing head 10 are rotated to polish a portion of the wafer. Herein, at a certain cycle during the continuous polishing of the wafer, a controller (not shown) controls the polishing head 10 to be positioned spaced apart from the polishing pad 16 and operates the driving of the CMP equipment including interrupting the supply of the slurry through the nozzle.

Further, the pad conditioner 14 plays an important role in the polishing operation, as follows:

First, the pad conditioner 14 sweeps the polishing pad so that the slurry of polishing solution is distributed uniformly around the whole surface of the wafer, which prevents the wafer from being locally polished. Second, if the polishing pad 16 contacts and continuously polishes the wafer 12, a groove of the polishing pad 16 is worn out due to friction therebetween and thereby degrading the performance of the polishing. The pad conditioner 14 exerts at its diamond disc a force against the polishing pad 16 so that the roughness of the polishing pad can be maintained at a certain level through the sweeping and rotation of the pad conditioner, which prevents the degradation in performance of polishing.

The operation of exchanging the polishing pad 16 supported by the platen 20 will now be described in the conventional wafer polishing apparatus, such as in the above apparatus. The wafer polishing apparatus including platens 20 is interrupted in its operation when all of the platens 20 are idled. Upon the exchange of the polishing pad 16, the polishing head 10 is moved or detached to provide a space for the pad exchange. Then, the used polishing pad 16 is removed and a new polishing pad 16 is attached to the platen 20. Finally, the polishing head 10 that has been moved or detached for securing the exchange space is returned to its original position.

However, the platen structure of the conventional wafer polishing apparatus constructed as above has a problem in that the exchange of the polishing pad is inconvenient and time-consumable to implement. This is because the exchange of the polishing pad supported by the platen is conducted by interrupting the operation of equipment, moving or detaching the polishing head for securing a space for exchange, and finally exchanging the polishing pad.

SUMMARY

Therefore, the present invention is directed to provide a platen structure of a polishing apparatus for semiconductor wafer and a method for exchanging a polishing pad affixed to the same in which the polishing pad supported by the platen is exchanged with convenience within a short time.

In accordance with an exemplary embodiment of the present invention, there is provided a platen structure of a polishing apparatus. The platen structure comprises a pad plate to which a polishing pad for polishing a wafer is attached and a platen body combined with the pad plate and defining at least one vacuum hole formed therein for providing a vacuum passage. The vacuum hole preferably forms a vacuum for moving the pad plate against the platen body.

The platen structure can further comprises at least one pusher seated to an edge portion of the platen body, and at least one pusher insert hole formed in the platen body into which the pusher is inserted. The pusher preferably moves up the pad plate upon the exchange of the polishing pad, so as to separate the pad plate from the platen body. The pusher is preferably a T-type pusher.

The pad plate and the platen body are preferably located opposite to each other, and are combined with each other. Preferably, the pad plate and the polishing pad can be formed in one piece. The pad plate and the polishing pad can also preferably be detachable from each other. The pad plate and the platen body preferably have uneven shapes, respectively.

A method for exchanging a polishing pad affixed to a platen of a polishing apparatus for semiconductor wafer can also be provided. The polishing apparatus can include a pad plate to which a polishing pad for polishing a wafer is attached, a platen body combined with the pad plate and having at least one vacuum hole formed thereto to provide a vacuum passage, at least one pusher seated to an edge portion of the platen body, and at least one pusher insert hole formed to the platen body and into which the pusher is inserted. The method can comprise the steps of providing a vacuum through the vacuum hole when the platen is in an idling state, without interrupting operation of the polishing apparatus, separating the pad plate from the platen body by pushing up the pad plate through raising the pusher, placing the pad plate having a new polishing pad attached thereto onto the pusher; lowering the pusher through the pusher insert hole such that a recessed portion of the pad plate is correspondingly engaged with a protruding portion of the platen body, and moving the pad plate against the platen body by maintaining the vacuum through the vacuum hole.

BRIEF DESCRIPTION OF THE DRAWINGS

The above and other features and advantages of the present invention will become more apparent to those of ordinary skill in the art by describing in detail preferred embodiments thereof with reference to the attached drawings in which.

DETAILED DESCRIPTION

The present invention will now be described more fully hereinafter with reference to the accompanying drawings. In describing the present invention, if considered that the details on the related known function or construction may unnecessarily render the scope of the present invention ambiguous, the detailed description thereof will be omitted.

Figure 1:
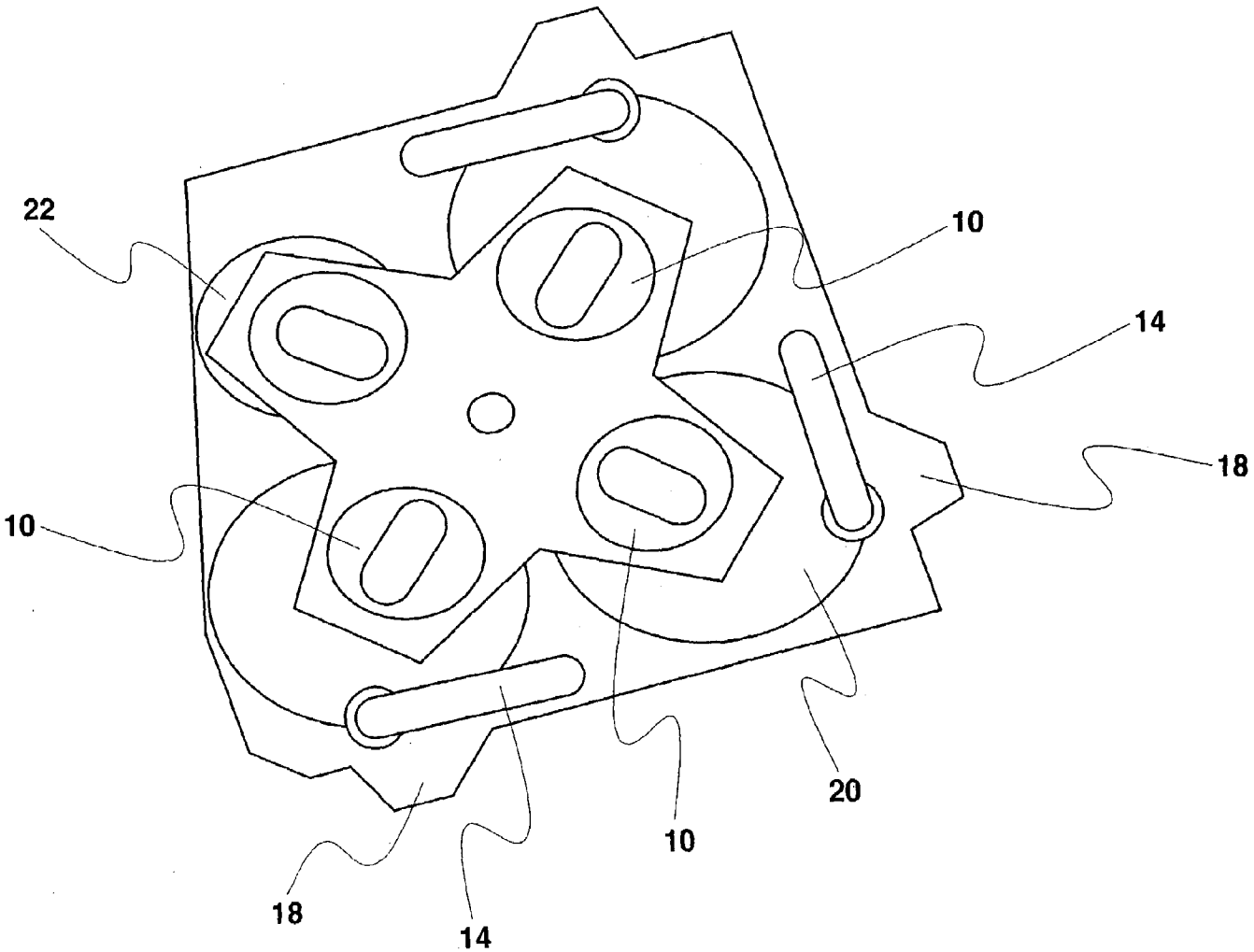
FIG.1 (PRIOR ART)
FIG. 1 is a plan view of a construction of a conventional wafer polishing apparatus.
Figure 2A:
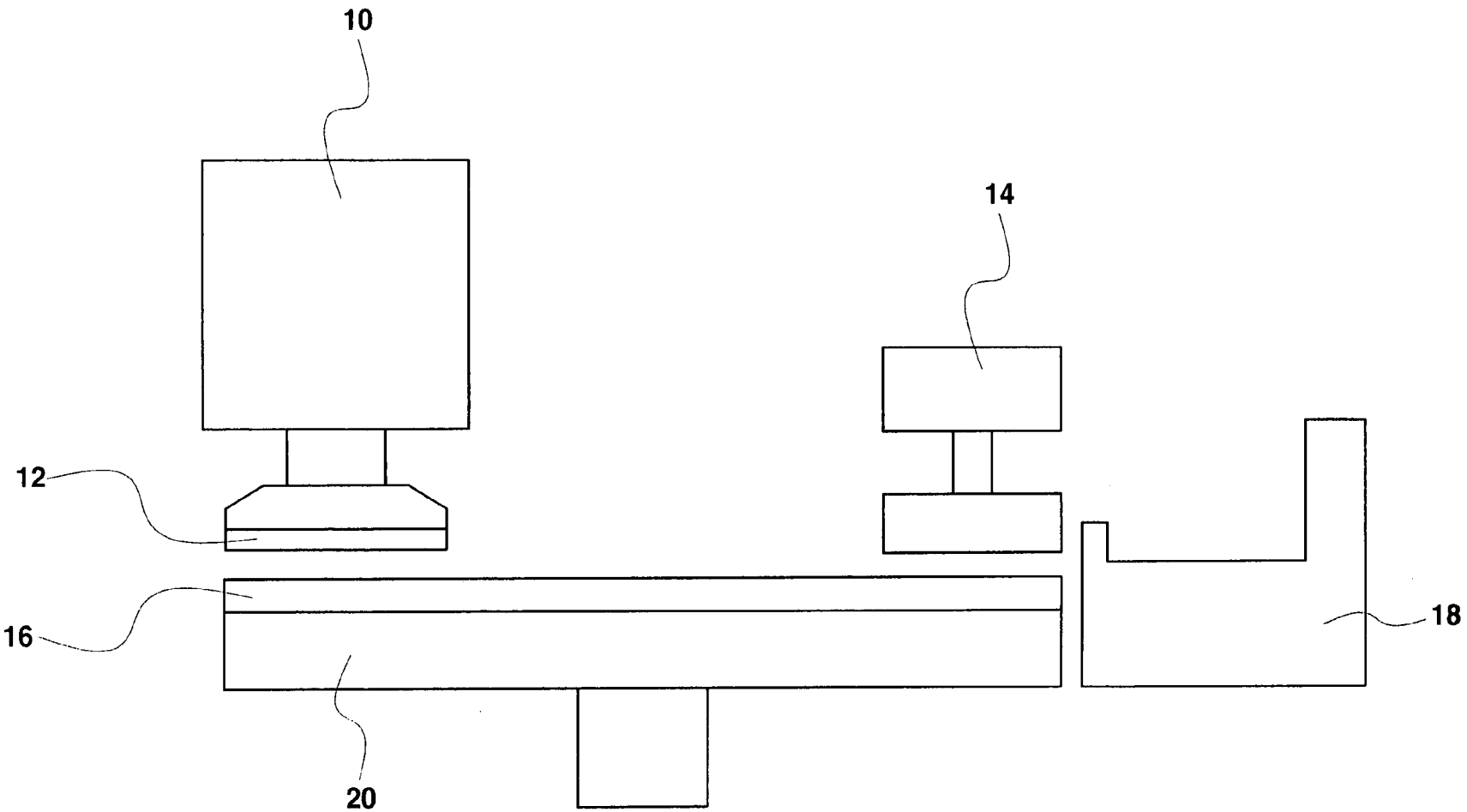
FIG.2a (PRIOR ART)
FIG. 2A is a view illustrating a conventional polishing apparatus for a semiconductor wafer wherein a pad conditioner of the apparatus is mounted to a polishing pad.
Figure 2B:
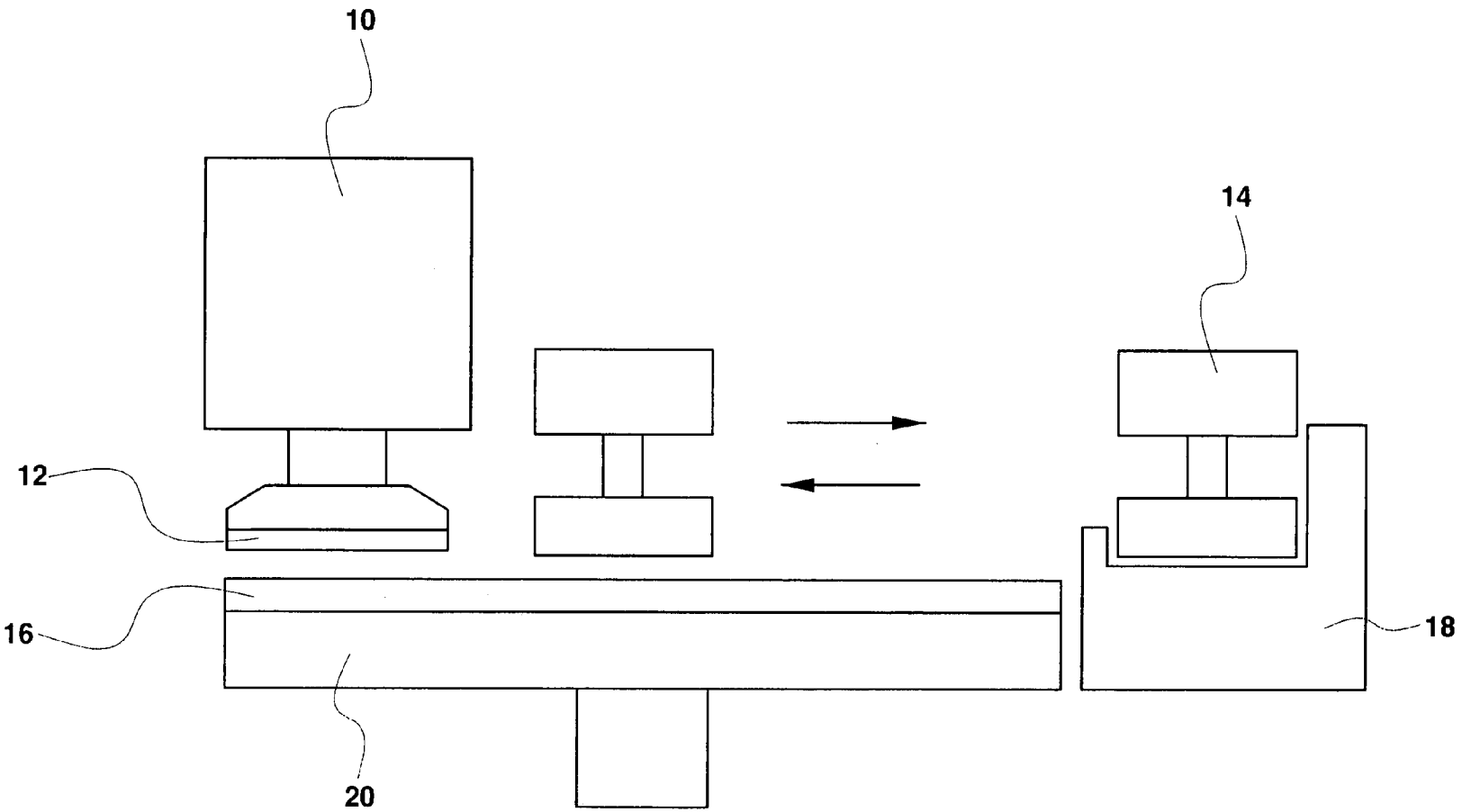
FIG.2b (PRIOR ART)
FIG. 2B is a view illustrating a conventional polishing apparatus for semiconductor wafer wherein a pad conditioner of the apparatus is mounted on a cleaning cup.
Figure 3:
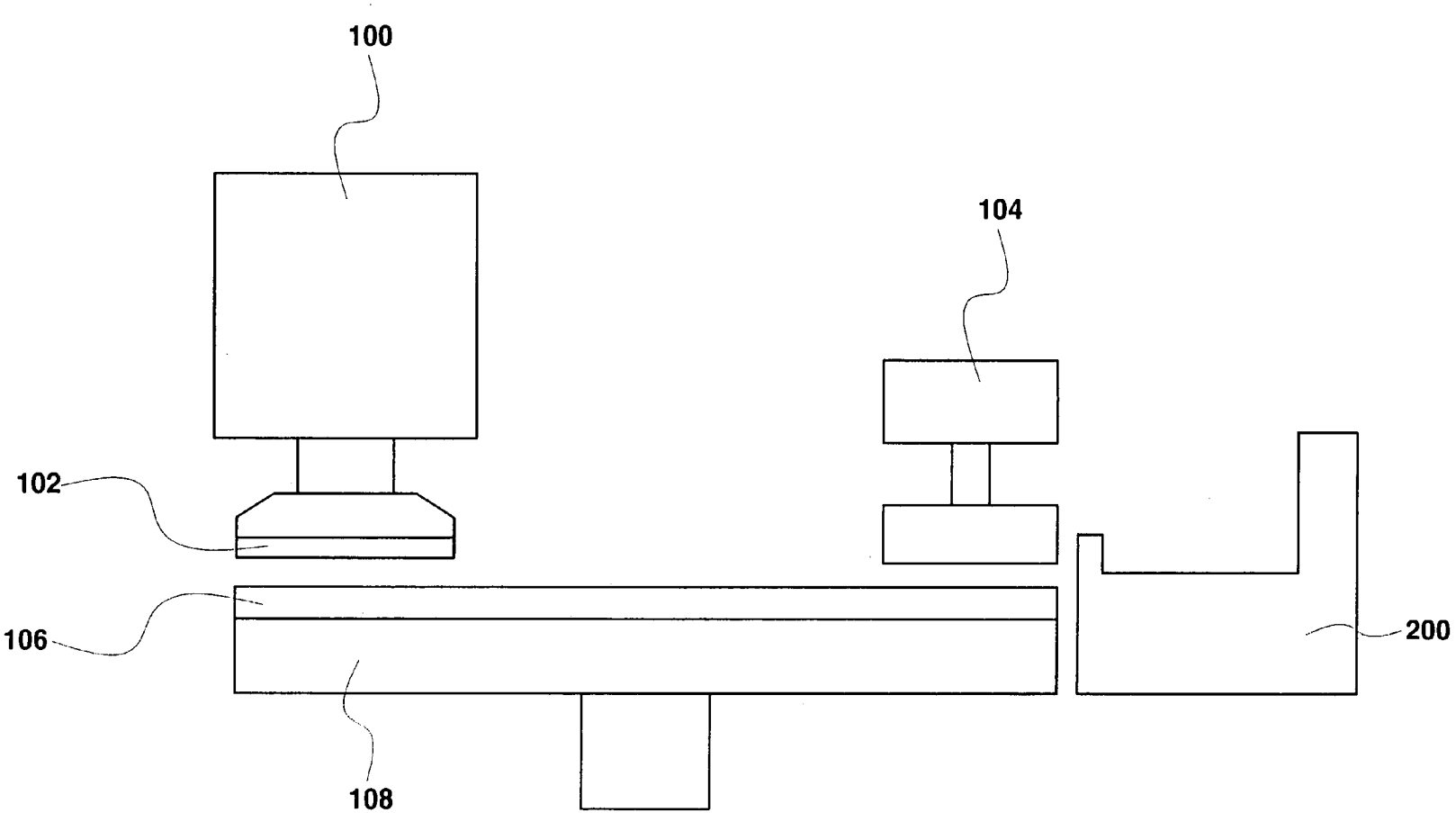
FIG. 3 is a view illustrating a wafer polishing apparatus according to an embodiment of the present invention.

Referring to FIG. 3, the polishing apparatus includes a polishing head 100 for vacuum sucking a wafer 102, a polishing pad 106 mounted below the polishing head 100 so as to polish the wafer 102, a platen 108 for fixing the polishing pad 106, a pad conditioner 104 mounted spaced in horizontal direction apart a certain distance from the polishing head 100 so as to maintain the surface state of the polishing pad 106 constant, and a cleaning cup 200 for cleaning the pad conditioner 104.

Figure 4:
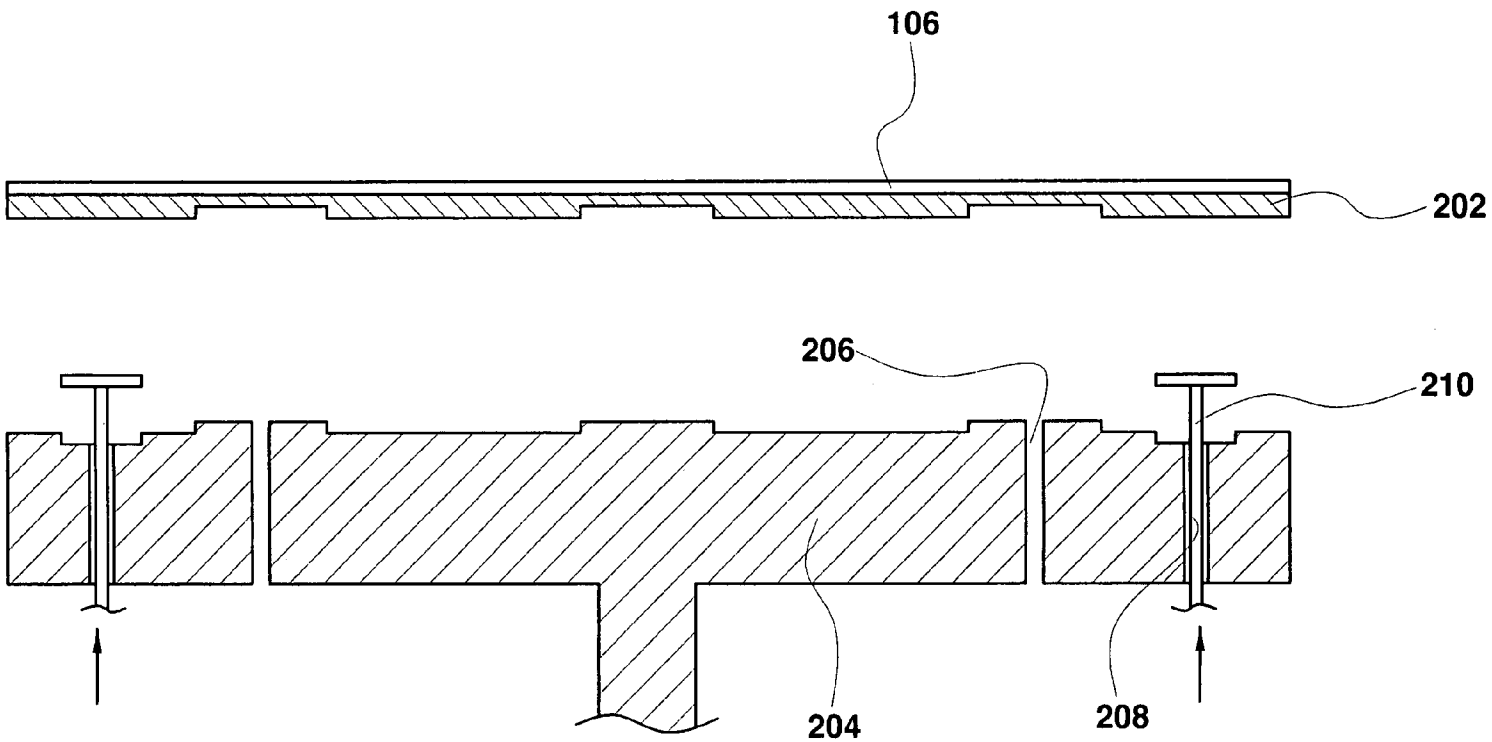
FIG. 4 is a view illustrating a platen 108 of FIG. 3 in a disassembled state.
Figure 5:
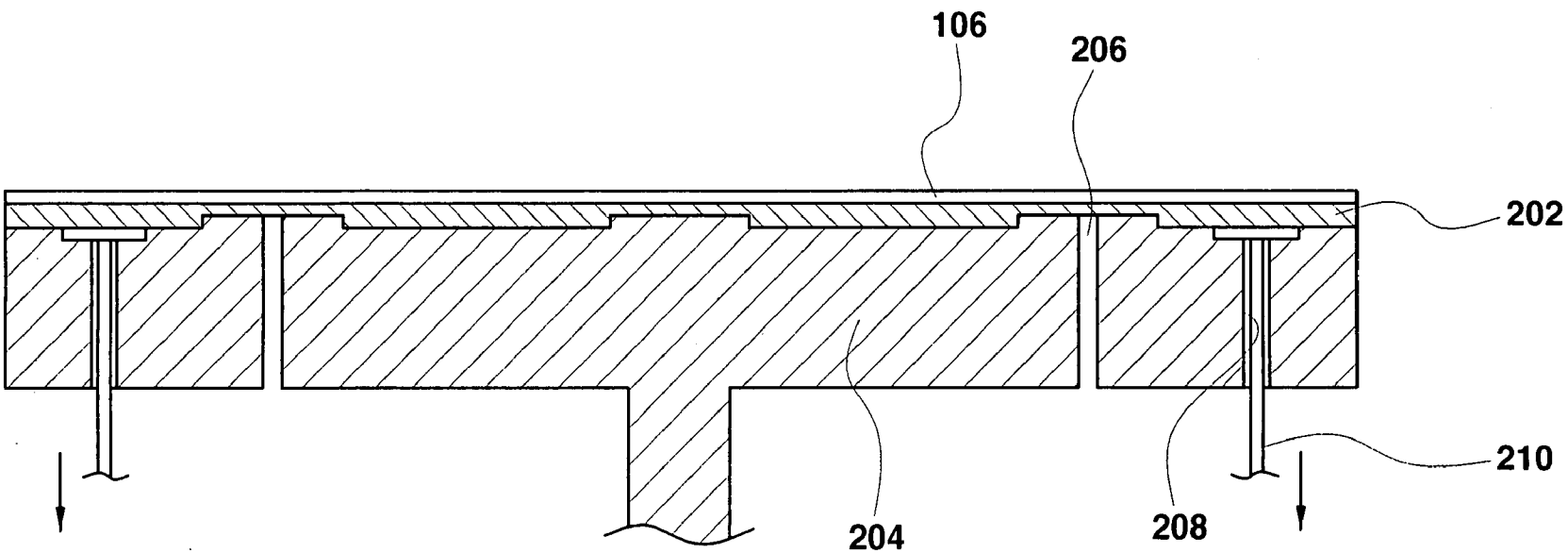
FIG. 5 is a view illustrating a platen 108 of FIG. 3 in an assembled state.

Referring to FIGS. 3–5, the platen 108 includes the polishing pad 106 for polishing the wafer 102, a pad plate 202 whose lower surface is formed with an uneven shape and supports the polishing pad 106, a platen body 204 whose upper surface is formed with an uneven shape and which is engaged with the pad plate 202, a pusher insert hole 208 formed in the recessed portion at an edge portion of the platen body 204, a plurality of T-type pushers 210 inserted into the pusher insert hole 208 and seated in the recessed portion of the edge portion of the platen body 204, a plurality of pusher insert holes 208 formed in the recessed portion of the platen body 204 and through which the T-type pushers 210 are inserted, and a plurality of vacuum holes 206 formed in the protruded portion of the platen body 204 to provide a vacuum passage.

The platen 108 of the present invention is configured such that the recessed portion of the pad plate 202 is engaged with the protruded portion of the platen body 204.

The operation of embodiments of the present invention will now be described in detail with reference to FIGS. 3–5.

In polishing operation of the wafer polishing apparatus to which the embodiments of the present invention are adapted, the wafer 102 is attached by vacuum to the polishing head 100, and the polishing head 100 holding the wafer 102 moves the wafer 102 to each platen 108. The polishing head 100 is moved toward the platen 108 and exerts a pressure thereto to thus press the wafer 102 placed between the polishing pad 106 on the platen 108 and the polishing head 100. The polishing pad 106 and the polishing head 100 are respectively rotated to polish a portion of the wafer. At this time, in order to assist wafer polishing, a slurry of polishing solution is supplied onto the polishing pad 106. To distribute the slurry uniformly around the whole surface of the wafer 102, a grinding disc attached to a pad conditioner 104 is moved on the polishing pad 106. Herein, the pad conditioner 104 is mounted spaced apart at a predetermined distance from the polishing head 100. When the pad conditioner is not operated, it may be positioned in the cleaning cup 200 to conduct a cleaning step. However, when the pad conditioner 104 is operated, the pad conditioner 104 is moved upwards within the cleaning cup 200, and is moved horizontally to press the polishing pad 106, thereby maintaining the surface state of the polishing pad 106 at a constant level.

After conditioning the wafer as describe herein, the pad conditioner 104 is moved upwards from the polishing pad 106, is moved horizontally to a position on the cleaning cup 200, and is lowered into the cleaning cup 200. A pressure for conditioning the polishing pad 106 can be, for example, about 5.5 psi, and a pressure for seating in the cleaning cup 200 can, for example, about 4.5 psi.

An operation of exchanging the polishing pad 106 supported by the platen 108 will now be described in the wafer polishing apparatus of the present invention described above.

The wafer polishing apparatus having a plurality of platens 108 introduces a vacuum through the plurality of vacuum holes 206 when all of the platens are in an idling state, without interrupting the operation of the apparatus, so that the pad plate 202 is not moved against the platen body 204 by the vacuum. Then, a user moves a plurality of pushers 210 upwards to raise the pad plate 202, separating the same from the platen body 204. Herein, the pad plate 202 has attached thereon the polishing pad 106. Thus, when the pad plate 202 is separated from the platen body 204, the polishing pad 106 is also separated therefrom. Then, the user places the pad plate 202 on the T-type pusher 210. The T-type pusher is attached on the new polishing pad 106. The T-type pusher 210 is then lowered through the pusher insert hole 208 so that the recessed portion of the pad plate 202 is engaged with the protruded portion of the platen body 204. In this state, if a vacuum is maintained through the plurality of vacuum holes 206 formed in the platen body 204, the pad plate 202 is moved against the platen body 204.

The pad plate 202 can be formed integrally with or separately from the polishing pad 106. In separated form, the polishing pad is separately attached to the pad plate.

The pad plate 202 and the platen body 204 are described herein with uneven shapes which are opposite to each other so as not to slip relative to each other upon polishing the wafer 102. These uneven shapes can include all of structures correspondingly engaged with each other so as not to slip relative to each other.

As described before, the polishing apparatus having a plurality of platens is constructed so that the polishing pad is attached to the pad plate and preferably can be separated from the platen body. This allows the pad plate to be detached from and attached to the platen body even in a narrow space between the platen and the polishing head. Thus, when the platens are idling, the polishing pad can be exchanged without interrupting the operation of the apparatus, so that the polishing pad can be readily and conveniently changed within a short time.

The invention has been described using preferred exemplary embodiments. However, it is to be understood that the scope of the invention is not limited to the disclosed embodiments. On the contrary, the scope of the invention is intended to include various modifications and alternative arrangements within the capabilities of persons skilled in the art using presently known or future technologies and equivalents. The scope of the claims, therefore, should be accorded the broadest interpretation so as to encompass all such modifications and similar arrangements.

What is claimed is:

1. A platen structure of a polishing apparatus, the platen structure comprising:

a pad plate to which a polishing pad for polishing a wafer is attached;

a platen body combined with the pad plate and defining at least one vacuum hole formed therein for providing a vacuum passage;

at least one pusher seated at an edge portion of the platen body for separating the pad plate from the platen body by raising the push against the pad plate; and at least one pusher insert hole formed in the platen body into which the pusher is inserted.

2. The platen structure according to claim 1, wherein the pad plate and the platen body are located opposite to each other, and are combined with each other.

3. The platen structure according to claim 2, wherein the pad plate and the polishing pad are formed in a single piece.

4. The platen structure according to claim 2, wherein the pad plate and the polishing pad are detachable from each other.

5. The platen structure according to claim 1, wherein the vacuum hole forms a vacuum for moving the pad plate into engagement with the platen body.

6. The platen structure according to claim 1, wherein the pusher moves up the pad plate upon the exchange of the polishing pad, so as to separate the pad plate from the platen body.

7. The platen structure according to claim 1, wherein the pad plate and the platen body have recessed and protruding portions which are corresponding engaged with each other.

8. The platen structure according to claim 1, wherein the pusher is a substantially T-type pusher.

9. A method for exchanging a polishing pad affixed to a platen of a polishing apparatus for semiconductor wafer, the polishing apparatus including a pad plate to which a polishing pad for polishing a wafer is attached, a platen body combined with the pad plate and having at least one vacuum hole formed thereto to provide a vacuum passage, at least one pusher seated at an edge portion of the platen body, and at least one pusher insert hole formed in the platen body and into which the pusher is inserted, the method comprising:

providing a vacuum through the vacuum hole when the platen is in an idling state, without interrupting operation of the polishing apparatus;

separating the pad plate from the platen body by pushing up the pad plate through raising the pusher;

placing the pad plate having a new polishing pad attached thereto onto the pusher;

lowering the pusher through the pusher insert hole such that a recessed portion of the pad plate is correspondingly engaged with a protruding portion of the platen body; and moving the pad plate into engagement with the platen body by maintaining the vacuum through the vacuum hole.

10. The method according to claim 9, wherein the pusher is a T-type pusher.

11. The method according to claim 9, wherein the pad plate and the polishing pad are formed in a single piece.

12. The method according to claim 9, wherein the pad plate and the polishing pad are detachable from each other.

13. The method according to claim 9, wherein the pad plate and the platen body have recessed and protruding portions which are corresponding engaged with each other.

14. A platen structure of a polishing apparatus, the platen structure comprising:

a pad plate to which a polishing pad for polishing a wafer is attached;

a platen body combined with the pad plate and having at least one vacuum hole formed therein for providing a vacuum passage;

at least one T-type pusher seated at an edge portion of the platen body for separating the pad plate from the platen body by raising the pusher against the pad plate;

and at least one T-type pusher insert hole formed in the platen body and into which the pusher is inserted.

15. The platen structure according to claim 14, wherein the pad plate and the platen body are located opposite to each other, and are combined with each other.

16. The platen structure according to claim 14, wherein the pad plate and the polishing pad are formed in a single piece.

17. The platen structure according to claim 15, wherein the pad plate and the polishing pad are detachably from each other.

18. The platen structure according to claim 14, wherein the vacuum hole forms a vacuum for moving the pad plate into engagement with the platen body.

19. The platen structure according to claim 14, wherein the pusher moves up the pad plate upon the exchange of the polishing pad, so as to separate the pad plate from the platen body.

20. The platen structure according to claim 14, wherein the pad plate and the platen body have recessed and protruding portions which are corresponding engaged with each other, respectively.

* * * * *